United States Patent [19]

Hollingshead

[11] Patent Number: 4,749,053

[45] Date of Patent: Jun. 7, 1988

[54] DRILL BIT HAVING A THRUST BEARING HEAT SINK

[75] Inventor: Frank A. Hollingshead, Duncanville, Tex.

[73] Assignee: Baker International Corporation, Houston, Tex.

[21] Appl. No.: 832,190

[22] Filed: Feb. 24, 1986

[51] Int. Cl.[4] ..... E21B 10/22

[52] U.S. Cl. ..... 175/371; 175/227; 175/410; 384/93

[58] Field of Search ..... 175/371, 372, 374, 410, 175/227, 228, 229; 384/92–95

[56] References Cited

U.S. PATENT DOCUMENTS

| | | | |
|---|---|---|---|
| 3,935,911 | 2/1976 | McQueen | 175/321 X |
| 3,944,306 | 3/1976 | Neilson | 384/94 |
| 3,990,751 | 11/1976 | Murdoch | 384/93 |
| 4,272,134 | 6/1981 | Levefelt | 384/93 |
| 4,304,444 | 12/1981 | Persson | 384/93 |
| 4,381,824 | 5/1983 | Patusek | 384/93 X |

*Primary Examiner*—George A. Suchfield
*Assistant Examiner*—David J. Bagnell
*Attorney, Agent, or Firm*—Carl Rowold

[57] ABSTRACT

A roller cutter drill bit adapted to drill bores in the earth comprising a bit body of steel having a plurality of bearing journals at its lower end, and a plurality of roller cutters, each having a recess therein receiving one of the journals. A radial bearing asembly for each roller cutter rotatably mounts the roller cutter on the journal, and an axial or thrust bearing assembly at the free end of each journal carries axial forces applied to the roller cutter during drilling, with the thrust bearing assembly thus being subject to rotary frictional forces and heating upon rotation of the drill bit during drilling. According to this invention, a heat dissipation member formed of material having higher thermal conductivity than steel is incorporated into the bit body. This material extends from the free end toward the attached end of the journal for conducting heat away from the thrust bearing assembly, thereby reducing bearing temperatures and providing longer bearing life.

11 Claims, 2 Drawing Sheets

DRILL BIT HAVING A THRUST BEARING HEAT SINK

BACKGROUND OF THE INVENTION

This invention relates to drill bits used to drill bores in the earth, and more particularly to so-called roller cutter drill bits of the type having frusto-conical roller cutters rotatably mounted thereon.

This invention involves an improvement over roller cutter drill bits of the type shown for example in U.S. Pat. No. 3,685,601, comprising a bit body of steel having means at its upper end adapted to be detachably secured to a drill string for rotating the bit and delivering drilling fluid under pressure to the bit body. At its lower end, the roller cutter has a plurality of legs (typically three such legs), each having a downwardly and inwardly extending bearing journal of generally cylindrical configuration having a free end and an attached end. The bit further includes a plurality of roller cutters, one for each journal, a radial bearing assembly for rotatably mounting the roller cutter on the journal, and an axial bearing assembly at the free end of each journal, constituting thrust bearing means. The thrust bearing means includes the so-called thrust face at the free end of the journal engaged in bearing relationship by the end of the bore in the respective roller cutter when axial force is applied to the roller cutter, as typically occurs during drilling operations, and the roller cutter is thus pressed against the thrust face of the journal. Upon rotation of the drill bit during drilling, the thrust bearing is thus subjected to rotary frictional forces and to heating. Heated to sufficiently high temperatures, the thrust bearing loses load carrying and low coefficient of friction properties. To remove heat from the thrust bearing, passaging is provided in the bit body for directing a portion of the drilling fluid past the axial bearing means. Nonetheless, heat build up can (and often does) occur at the thrust bearing, with the result that the thrust bearing loses, at least to some extent, its bearing properties and its expected life is reduced. In an extreme case the bearing may begin to melt, with resultant rapid destruction of the bit. Unexpected destruction of a bit while in the drill bore may result in pieces or parts of the bit being left behind in the drill bore when the drill bit is removed. These parts must be removed in a separate operation before drilling can be resumed with a new drill bit.

SUMMARY OF THE INVENTION

Among the several objects of this inventions may be noted the provision of a roller cutter drill bit having a heat sink feature for preventing heat build-up at its thrust bearing means; the provision of such a drill bit having high thermal conductivity material carried in the journal for conducting heat away from the thrust bearing means; the provision of such a drill bit having high thermal conductivity material carried in a bore extending from the thrust bearing means toward the attached end of the journal for increased heat transfer from the relatively small thrust bearing means to the relatively large attached end of the journal; and the provision of such a drill bit having a heat skin feature that can be readily and inexpensively incorporated into drill bits of otherwise conventional designs.

In general, the drill bit of this invention comprises a bit body of steel having means at its upper end adapted to be detachably secured to a drill string for rotating the bit and a plurality of spaced apart legs at its lower end, each leg having a downwardly and inwardly extending bearing journal of generally cylindrical configuration having a free end and an attached end. A plurality of roller cutters, one for each journal, are mounted on the journals. Each roller cutter is of frusto-conical shape and has a blind end bore of generally circular shape in section in the base thereof adapted to receive the respective journal. Radial bearing means for each roller cutter at the annular surface of the bore therein mounts the roller cutter on the journal for rotation about the journal. Axial bearing means at the free end of each journal, constituting thrust bearing means, is engaged in bearing relationship by the end of the bore in the respective roller cutter when axial force is applied to the roller cutter during drilling. The thrust bearing means is subject to rotary frictional forces and heating upon rotation of the drill bit by the drill string during drilling. Heat dissipation means having significantly higher thermal conductivity than steel is carried in the journal and extends from the free end toward the attached end of the journal for conducting heat away from the thrust bearing means for reduced bearing temperatures and longer bearing life.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBDODIMENTS

Figure 1:
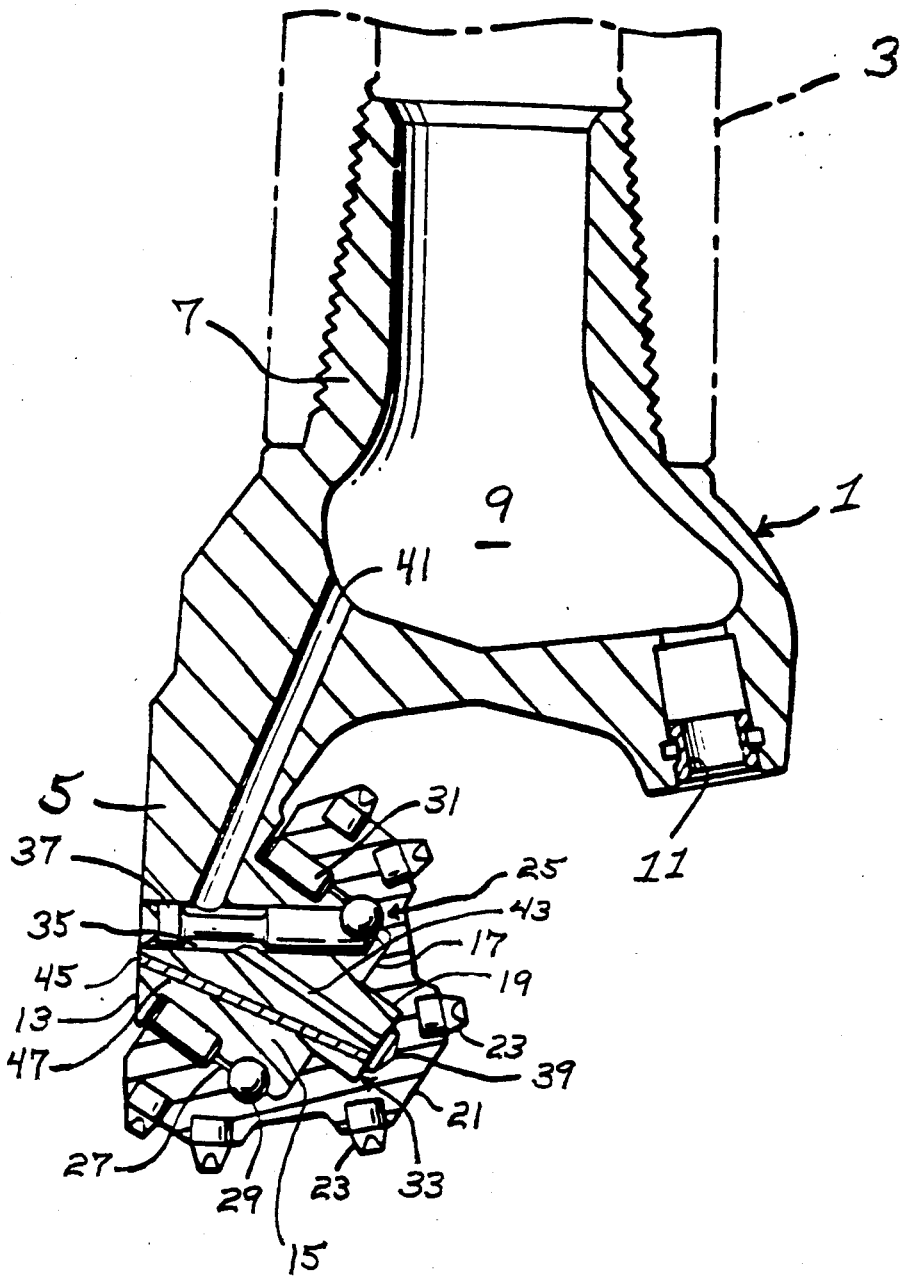
FIG. 1 is a vertical central section of a drill bit of this invention showing one bearing journal of the drill bit, a roller cutter mounted thereon, and heat dissipation means carried in the journal.

Referring to FIG. 1, there is generally indicated at 1 a first embodiment of a drill bit of this invention used in conjunction with a drilling machine (not shown) having a drilling fluid circulation system for drilling bores in the earth. In the mining industry, this drilling fluid is typically air under pressure, which is delivered to a tubular drill string (a portion of which is shown in phantom at 3 in FIG. 1) from air compressors (not shown) at the drilling machine.

The drill bit comprises a bit body 5 of suitable metal, such as low carbon steel (e.g., ASTM 1020), having a threaded pin 7 at its upper end adapted to be threaded in the end of the drill string. The drill string serves to rotate the bit and to deliver the fluid under pressure to the drill bit. The bit body also has a chamber at its upper end (shown at 9 in FIG. 1) for receiving drilling fluid under pressure from the passage in the drill string, and a plurality of nozzles (typically three such nozzles, with one such nozzle being shown at 11 in FIG. 1) in fluid communication with the chamber for directing a portion of the drilling fluid under pressure delivered to the bit body toward the end of the drill bore. The drilling fluid from the nozzles impinges the end of the drill bore, entrains the drilling cuttings and carries the cuttings away from the end of the drill bore for removing the cuttings from the bore.

At its lower end, the bit body has a plurality of spaced apart legs (typically three such legs, with one such leg being shown at 13 in FIG. 1). Each leg has a downwardly and inwardly extending bearing journal 15 of generally cylindrical configuration having a free end and an attached end. The free end of the journal includes an annular shoulder portion 17 and central projecting portion, or so-called nose pin 19. A plurality of roller cutters 21, one for each journal, are mounted on the journals. The roller cutters are of generally frustoconical shape, and have a blind end bore in the base thereof adapted to receive the respective journal 15. Cutting elements, such as tungsten carbide inserts 23 are provided at the outer surface of the roller cutters, adapted to bear against the end of drill bore for drilling the formation.

As illustrated in FIG. 1, bearing means 25 are provided in the bearing cavity 27 between the journal and the roller cutters comprising radial bearing means, such as ball bearings 29 and roller bearings 31, at the annular surface of the bore in the roller cutter, and axial bearing means 33, constituting thrust bearing means, at the free end of the journal. The radial bearing means mounts the roller cutter on the journal for rotation about the journal, and secures the roller cutter on the journal against downward axial forces tending to move the roller cutter down off the journal. The roller bearings and ball bearings are installed in the drill bit during assembly using conventional means, such as a ball loading port 35 in a ball pin 37 closing the port as shown in FIG. 1. The thrust bearing means 33 includes the axial end or thrust face of the journal engaged by the blind end of the bore in the roller cutter during drilling operations. Thus, the thrust face may include the end face of the nose pin 19, as well as the face of the shoulder portion 17. The thrust bearing means may further include a so-called thrust button 39 of suitable bearing metal, such as M2 tool steel, secured in the bore in the roller cutter and engageable with the thrust face of the nose pin.

During drilling operations as the drill bit is rotated and pressed against the end of the drill bore by the drill string, the roller cutters 21 turn on the journals 15 and apply axial force against the thrust faces of the journals. This creates rotary frictional forces on the thrust faces and resultant heating of the thrust bearing means 33. Without adequate dissipation of the frictional heat generated, the thrust bearing means may become heated to a temperature causing the thrust bearing members to lose, at least to some extent, their bearing properties and thus reduce bearing life. At extreme temperatures, the bearing means may begin to melt, with resultant rapid destruction of the drill bit. Unexpected destruction of the drill bit while in the drill bore may result in pieces or parts of the bit being left behind in the drill bore when the drill bit is removed, which must then be removed in a separate operation before drilling can resume in the same drill bore with a new drill bit.

Dissipation of the frictional heat generated at the thrust bearing means is effected to a limited extent by the journal 15 itself. More particularly, the journal conducts the frictional heat away from the thrust bearing means 33 at the free end of the journal toward the attached end of the journal and the remainder of the respective leg. At the leg, heat is dissipated via convection of drilling fluid flowing from the end of the well bore. However, being formed of steel which has relatively low heat conduction properties as compared to copper or silver, the journal 15 typically is unable to conduct sufficient heat away from the thrust bearing means to prevent the bearing means 33 from reaching unacceptably high temperatures during drill operations.

To assist the journal in dissipating this frictional heat, the bit 5 is provided with passaging comprising a passage 41 in the leg for flow communication between the chamber 9 and the ball loading port 35, and a passage 43 in the journal for flow communication between the ball loading port 35 and the bearing cavity 27. The passing thus directs a portion of the relatively cool drilling fluid delivered to the chamber 9 in the drill bit to the bearing cavity 27. The passage 43 opens to the thrust face of the nose pin 19, with the drilling fluid thus flowing past the thrust face, the thrust button 39, the surfaces of the journal and the bore in the roller cutter, the ball bearings 29 and roller bearings 31 before exiting the drill bit at the annular space between the roller cutter and the journal at the attached end thereof. As the drilling fluid flows past these bearing members it dissipates frictional heat via convention. While the incorporation of such passaging in the bit body 5 has been successful in many drilling operations in preventing excessive temperatures from being generated at the thrust bearing means, nonetheless the rate of frictional heat generation at the thrust bearing means 33 may in certain conditions exceed the rate of heat dissipation of the journal and drilling fluid directed past the bearing means, with resultant heating of the thrust bearing means to unacceptably high temperatures. As described above, such temperatures may result in reduced bearing life and perhaps unexpected bit failure.

In accordance with this invention, the drill bit 1 is provided with heat dissipation means comprising material 45 having significantly higher heat conductivity than steel carried in the journal and extending from the free end toward the attached end of the journal. This heat dissipation means acts as a heat sink in transferring frictional heat away from the thrust bearing means 33 for reduced bearing temperatures and longer bearing life. As shown in FIG. 1, the heat dissipation means comprises a quantity of high thermal conductivity material 45 such as copper or silver in a generally cylindrial bore in the journal for extending from the free end toward the attached end thereof. The high conductivity material is preferably in the form of a generally cylindrical solid bar tightly fitted in the bore 47 in surface-to-surface engagement with the bore throughout substantially the entire length of the bar, but may also be in the form of powder tightly packed into the bore. In the first embodiment of the drill bit, as shown in FIG. 1, the bore (and thus the high conductivity material carried therein) extends generally along the longitudinal axis of the journal and opens to the thrust face at the end of the nose pin 17 at a point spaced from the central axis of the journal. Being formed of copper or silver which has good lubricating properties and being positioned away from the central axis of the journal, the heat dissipation material may also serve as a solid lubricant to the thrust bearing means. More particularly, as the thrust button 39 rotates past the exposed end of the heat dissipation material 45, it tends to wipe this material across the thrust face, thereby supplying lubricant thereto.

Figure 2:
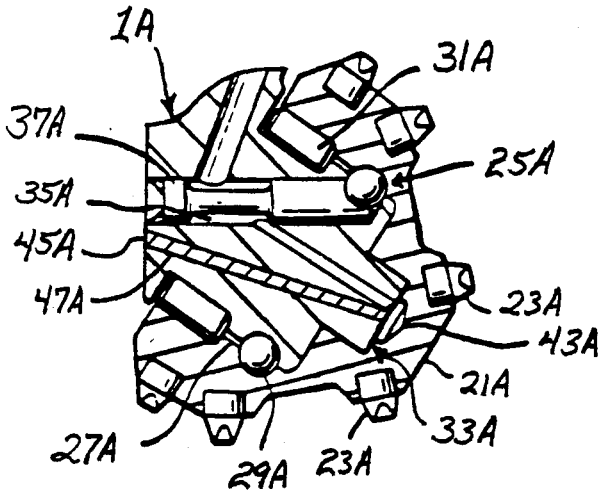
FIG. 2 is a partial vertical central section of a second embodiment of a drill bit of this invention showing heat dissipation means terminating at the free end or thrust face of the journal at a point different than that in FIG. 1.
Figure 3:
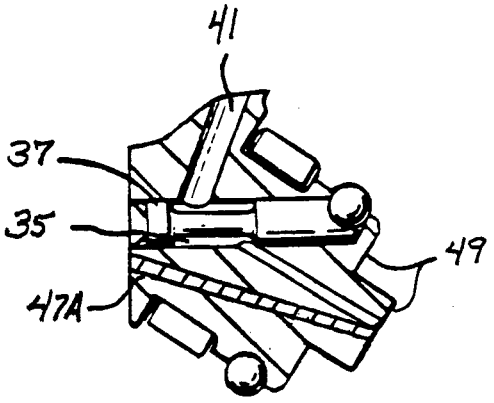
FIG. 3 is a partial section of the drill bit of FIG. 2 showing wear resistant material at the free end of the journal.

In a second embodiment of the drill bit 1A, as shown in FIGS. 2 and 3, the bore 47A opens to the thrust face at a point on the central axis of the journal. Being so positioned, the heat dissipation material 45A does not serve as a source of lubricant to a significant portion of the thrust face of the nose pin, but still serves to conduct frictional heat away from the thrust bearing means 33A.

Figure 5:
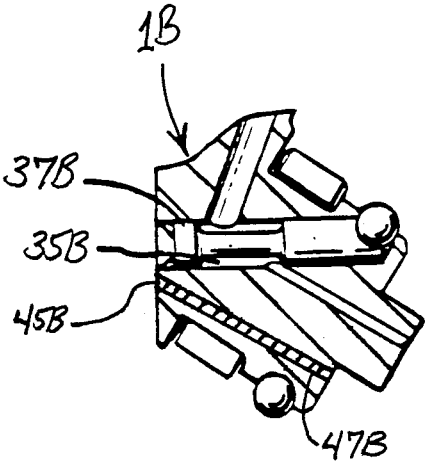
FIG. 5 is a partial section of a third embodiment of the drill bit showing the heat dissipation means terminating at the annular portion of the thrust face around the nose pin.

In a third embodiment of the drill bit 1B, as shown in FIG. 5, the bore 47B opens to the thrust face of the shoulder portion 17B of the free end of the journal. In this embodiment, the heat dissipation material 45B serves as a source of solid lubricant for this thrust face, as well as to conduct heat therefrom. It is contemplated that a drill bit of this invention may have both the heat dissipation means of the type shown in FIGS. 1–3 extending to the nose pin 19 and the heat dissipation means shown in FIG. 5 extending to the shoulder portion 17 for improved bearing lubrication and reduced bearing temperatures of the entire thrust bearing means.

Figure 4:
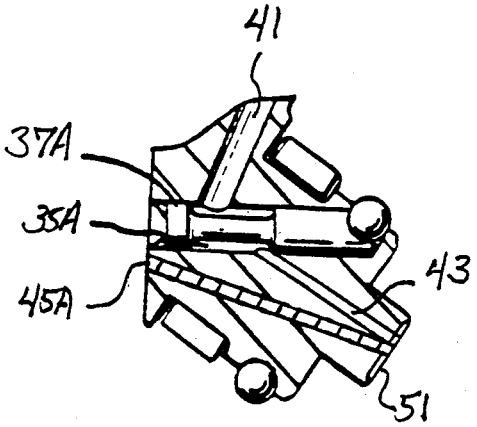
FIG. 4 is a partial section similar to FIG. 3 showing a disc of wear resistant material secured to the end of the so-called nose pin at the free end of the journal.

For reduced bearing temperatures and extended bearing life, it is also contemplated that the thrust face of the free end of the journal 15 may be provided with material having greater wear resistance than the mild steel of the bit body 5. As shown in FIG. 3, the thrust surfaces may be carburized by known metallurgical processes to form a high wear-resistant surface 49. Alternatively this surface 49, for example, may be coated by plasma spraying with a layer of suitable wear resistant material such as "Stellite". As shown in FIG. 4, the thrust face may also be provided with a insert or disc 51 of such wear resistant material such as "Stellite" secured as by welding in a recess formed in the thrust face of the nose pin A. This insert 51 is provided with an opening in alignment with the bore 47 to receive the end of the heat dissipation material.

In view of the above, it will be seen that the several objects of the invention are achieved and other advantageous results attained.

As various changes could be made in the above constructions without departing from the scope of the invention, it is intended that all matter contained in the above description or shown in the accompanying drawing shall be interpreted as illustrative and not in a limiting sense.

I claim:

1. A roller cutter drill bit adapted to drill bores in the earth, said bit comprising:

(A) a bit body of steel having at its upper end adapted to be detachably secured to a drill string for rotating the bit and a plurality of spaced apart legs at its lower end, each leg having a downwardly and inwardly extending bearing journal of generally cylindrial configuration having a free end and an attached end;

(B) a plurality of roller cutters, one for each journal, each roller cutter being of frusto-conical shape and having a blind end bore of generally circular shape in section in the base thereof adapted to receive the respective journal;

(C) radial bearing means for each roller cutter at the annular surface of the bore therein for mounting the roller cutter on the journal for rotation about the journal;

(D) thrust bearing means at the free end of each journal, constituting the thrust face thereof, in bearing relationship with the end of the bore in the respective roller cutter when axial force is applied to the roller cutter during drilling, with said thrust bearing means being subject to rotary frictional forces and heating upon rotation of the drill bit by the drill string during drilling; and (E) heat dissipation means comprisng a generally cylindrical bore in the journal extending generally in the direction of the longitudinal axis of the journal and opening to the free end of the journal, and a generally cylindrical solid bar of metal having significantly higher thermal conductivity than steel affixedly secured in said generally cylindrical bore in surface-to-surface engagement with said generally cylindrical bore throughout substantially the entire length of the bar and carried in the journal said bar extending from the thrust face of the journal to the attached end of the journal for conducting heat away from the thrust bearing means for reduced bearing temperatures and longer bearing life.

2. A roller cutter drill bit as set forth in claim 1 wherein said metal comprises copper.

3. A roller cutter drill bit as set forth in claim 1 wherein said metal comprises silver.

4. A roller cutter drill bit as set forth in claim 1 wherein said generally cylindrical bore opens to the thrust face of the journal at a point on the longitudinal central axis of the journal.

5. A roller cutter drill bit as set forth in claim 1 wherein said generally cylindrical bore opens to the thrust face of the journal at a point spaced from the longitudinal central axis of the journal.

6. A roller cutter drill bit as set forth in claim 1 wherein said thrust bearing means comprises wear resistant material on the journal at the thrust face thereof.

7. A roller cutter drill bit as set forth in claim 6 wherein the journal at its thrust face thereof has been carburized, this carburized surface constituting said wear resistant material.

8. A roller cutter drill bit as set forth in claim 6 wherein a coating of said wear resistant material is applied to the thrust face of the journal.

9. A roller cutter drill bit as set forth in claim 6 wherein a disc of said wear resistant material is secured to the thrust face of the journal.

10. A roller cutter drill bit as set forth in claim 9 wherein the disc of wear reistant material has an opening therein receiving an end of said heat dissipation means.

11. A roller cutter drill bit as set forth in claim 6 wherein the wear resistant material is "Stellite".

* * * * *